United States Patent [19]

Bode et al.

[11] 3,961,588

[45] June 8, 1976

[54] THRUST GRATE WITH A SERIES OF OVERLAPPING ROWS OF PLATES

[75] Inventors: Herbert Bode, Wohltorf; Manfred Göllner; Günther Köberer, both of Hamburg, all of Germany

[73] Assignee: Claudius Peters AG, Hamburg, Germany

[22] Filed: July 1, 1975

[21] Appl. No.: 592,172

[30] Foreign Application Priority Data

July 6, 1974 Germany ..... 2432599

[52] U.S. Cl. ..... 110/38; 34/164

[51] Int. Cl.[2] ..... F23B 1/22

[58] Field of Search ..... 110/35, 38, 33; 34/164; 126/174; 432/239

[56] References Cited

UNITED STATES PATENTS

| | | | |
|---|---|---|---|
| 2,431,799 | 12/1947 | Gaffney | 110/38 X |
| 3,321,845 | 5/1967 | Boron | 34/164 |
| 3,624,920 | 12/1971 | Coutelan | 34/164 |
| 3,753,299 | 8/1973 | Schreiner | 110/38 |
| 3,871,287 | 3/1975 | Spillman et al. | 110/38 |

*Primary Examiner*—Kenneth W. Sprague
*Attorney, Agent, or Firm*—Otto John Munz

[57] ABSTRACT

A thrust grate with several rows of grate plates, with each preceding plate of a row overlapping the next following plate of the following row has the rows of grate plates alternatingly fixed and reciprocating in the longitudinal direction of the grate. The fixed grate plates are rigidly mounted by means of a fastening device on grate plate supports, which are arranged transversely to the longitudinal direction of the grate. The fastening device has a support surface extending essentially parallel to the longitudinal direction of the plates, and transversely thereto a stop surface on the grate plate support and on each grate plate. The fastening device has also a traction element which holds the grate plate on the grate plate carrier.

13 Claims, 4 Drawing Figures

THRUST GRATE WITH A SERIES OF OVERLAPPING ROWS OF PLATES

CROSS-REFERENCE TO A RELATED APPLICATION

Priority of corresponding German application No. P 2,432,599.3, filed July 6, 1974 is claimed under the Convention.

DESCRIPTION OF THE PRIOR ART

The prior art is represented by U.S. Pat. No. 3,624,920 to P. A. Coutelan, dated Dec. 7, 1971.

In grate plates which are not rigidly connected with the grate plate supports a pivotable connection between the grate plate carriers and the grate plates in the rear portion of the grate plates is sufficient since the front end of each grate plate is supported by resting on the next grate plate located in front of it. Such arrangements are shown broadly for instance in U.S. Pat. No. 3,170,577 of Feb. 23, 1965 to J. J. Martin and U.S. Pat. No. 3,580,195 of May 25, 1971 to J. J. Martin. The grate type of the prior art in which a sliding of plates on each other is to be avoided, necessitates a rigid fastening to absorb the forces between the grate plates and the grate plate supports. In order to assemble and disassemble the plate from the bottom side of the grate, a fastening device is provided in the rear portion of the plate. In this structure a comparatively extended support surface is provided for the purpose of transferring the weight of the plate and of the material layer resting thereon. The support surface is normally arranged so as to extend parallel to the longitudinal direction of the plate. This structure is also feasible for a device slightly inclined with respect to the direction of the plate insofar as it is suited to assure the desired power transfer. Since this support surface which extends essentially parallel to the longitudinal plate direction is generally unsuitable for transferring the pushing forces, a stop that fixes the plate in its longitudinal direction is also provided whose plane extends transversely to that of the support surface.

In the grate disclosed in U.S. Pat. No. 3,624,920 the plate is provided on the front side of the grate support with a downward projecting extension which forms the stop surface and also has to transfer the compressive forces originating from the load on the front end of the plate, to the grate plate support. This requires the provision of a tension bolt at the highest possible level, which makes accessibility for purposes of exchanging worn plates difficult and also disadvantageously increases the thermal stress of the bolt. The forces acting in the direction of the forward thrust upon the plate must be fully absorbed by the bolt.

SUMMARY OF THE INVENTION

The objects of the invention are:

to provide a grate plate which avoids the imperfections of the prior art;

to provide a grate plate fastening with a well accessible traction element largely relieved from the thermal loads and forces that act directly upon the plate;

to provide a grate plate assembly which makes it possible to replace a damaged or worn plate from the bottom side of the grate while avoiding the hot space above the grate.

Other objects and advantages of the present invention will become apparent to those skilled in the art from the following description, drawings and claims.

DESCRIPTION OF THE PREFERRED EMBODIMENT

Figure 1:
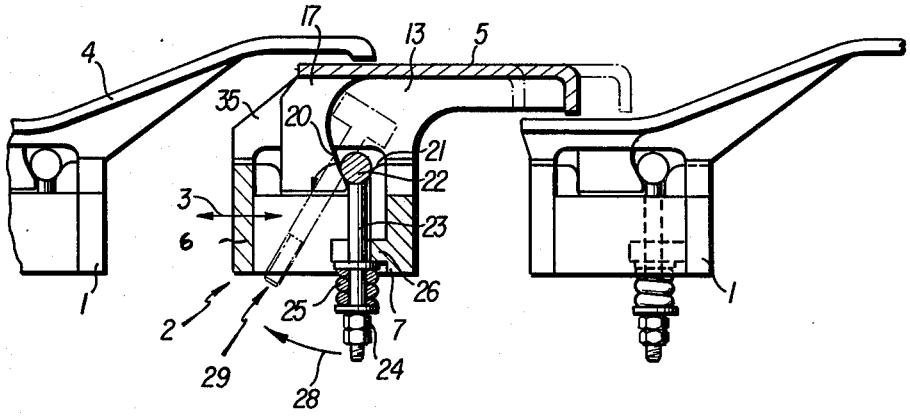
FIG. 1 is a side view partially in cross-section of three overlapping grate plates with the corresponding grate plate supports in a linear alignment in the direction of reciprocation.
Figure 2:
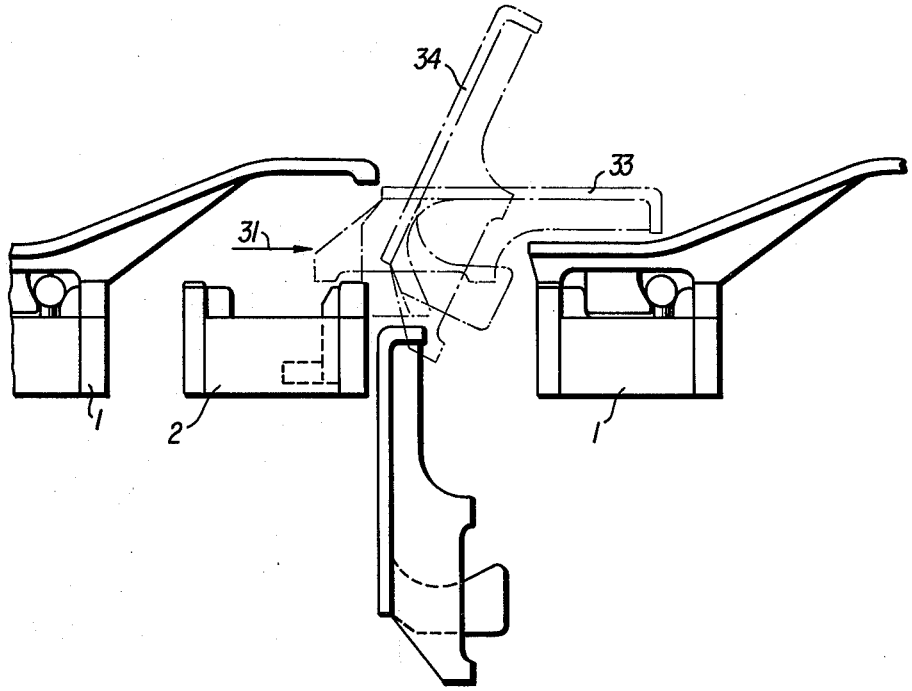
FIG. 2 is a side view corresponding to that of FIG. 1 showing different positions of the central plate.

There is shown on FIGS. 1 and 2 a portion of a grate plate group having grate plate supports 1 and 2 respectively, each of which supports a row of grate plates, which are alternatingly fixed plates 4 and movable plates 5 and extend transversely to the direction of the grate. The grate plate support 1 hereinafter is identified as the fixed support. The grate plate support 2 as the reciprocating support.

The reciprocating support is driven reciprocably back and forth in the direction of arrow 3. The fixed and the movable grate plate supports are capable of supporting grate plates of different shapes and are provided for a grate with a horizontal extension and horizontal direction of movement of the movable plates.

The invention, however, is applicable also to inclined or ascending grates and independently of the prevailing shape of the grate plate.

Figure 3:
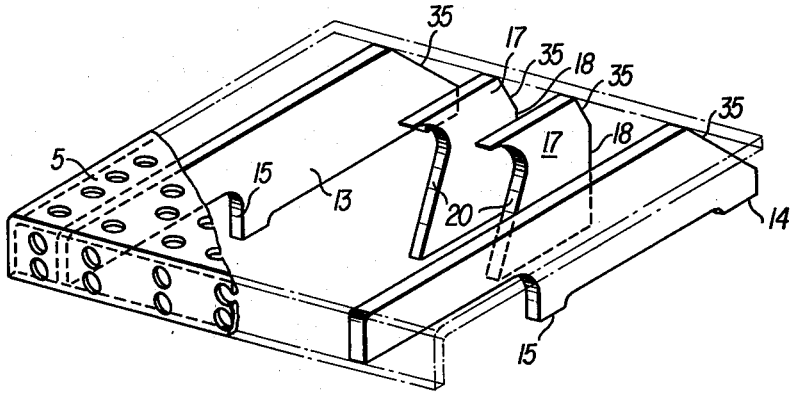
FIG. 3 is a perspective view with portions cut off of the grate plate appearing in the center of FIGS. 1 and 2.
Figure 4:
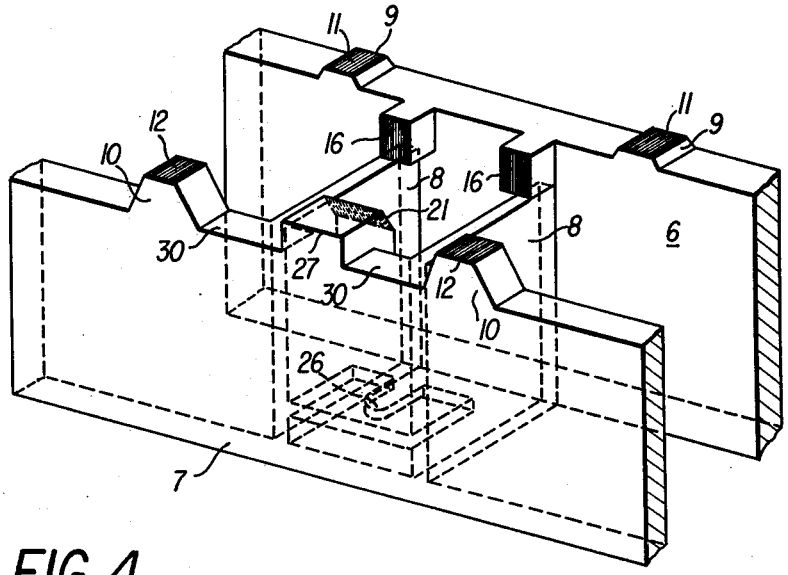
FIG. 4 is a perspective view of the corresponding grate plate support.

The grate connector devices cooperating on the grate plate supports and the grate plates for their mutual connections are the same for all types of grate plates and are hereinafter described by reference to the plate with a corresponding grate plate support shown on FIGS. 1 and 2 in the center and on FIGS. 3 and 4.

The grate plate support has two parallel flanges 6 and 7, which are rigidly connected by walls 8 extending perpendicularly to the planes of the flanges. Wherever a grate plate is to be supported by the grate plate supports, flanges 6 and 7 are provided, on the top side, each with two elevations 9 and 10 for the formation of supporting surfaces 11 and 12 for the grate plate. The support surfaces 12 of the front flange 7 are located in the direction of the forward thrust, exactly in front of the support surfaces 11 of the rear flange 6. The plate portion of the grate plate is shown on FIG. 3 broken off for the sake of clarity and is indicated in dot and dash lines only. Beneath it at the locations of the support surfaces 11, 12 of the grate plate support extending in longitudinal direction are ribs 13, which form support rib surfaces 14 and 15 on the bottom side. The distances of the ribs correspond exactly to those of the support plate surfaces 11 and 12. Thus each plate can be safely mounted by means of the support surfaces arranged on the said plate or the grate plate support. While in the embodiment shown all grate plate supports are located on a common plane extending parallel to the grate plane, this is not absolutely necessary.

The rear flange 6 of the grate plate support is provided, on the side facing the front, symmetrically between the support surfaces 11 with stop flange surfaces 16 on a common plane which extends essentially perpendicularly to the grate plane. The grate plate is provided, on the bottom side between the ribs 13 with two plate projections 17 in a symmetrical arrangement, whose distance equals that of the stop flange surfaces 16 and whose rear surfaces form corresponding stop plate surfaces 18. As shown on FIG. 1 in assembly the stop surfaces 18 abut against the stop surfaces 16. The stop rib and plate surfaces 11, 12 and 14 and 15 assure the correct adjustment of the grate plate with respect to the horizontal plane. The cooperating flange stop 16 and 18 assure the correct position in the longitudinal direction of the grate, as well as the correct angle adjustment.

The front sides of the projections 17 and 18 of the grate plates form in symmetrical arrangement forward slanting wedge surfaces which enclose with the planes of the support rib surfaces 14 and 15 an angle below 90°. Correspondingly, the front flange 7 of the grate plate support forms in a position approximately facing the wedge surfaces 20, a wedge surface 21 with an inclination opposite relative to the planes of support plate surfaces 11 and 12. The wedge surfaces 20 and 21 jointly form a wedge angle whereby, as shown on FIG. 1 of completed assembly a wedge element 22 is provided which, by means of a tension bolt 23, is pulled into the wedge angle. The wedge assembly is supported by means of nuts 24 via a compression spring 25 by a forklike support element 26 of the grate plate support. The wedge element 22 exerts upon the wedge surfaces 20 of the grate plate a force with force components extending downward and rearward, which press the grate plate with its support rib surfaces 14, 15 upon the support plate surfaces 11, 12 of the grate plate support and protect the plate against lifting forces. The stop plate surfaces 18 of the grate plate support are pressed against the stop flange surfaces 16 of the grate plate support whereby the grate plate is protected against forces acting in the longitudinal direction of the grate. The tension bolt is mounted spaced a large distance from the hottest portions of the plate and, due to the wedge effect, is required to absorb only a small portion of the forces necessary to hold the plate at the given location. The compression spring is rated and tensioned in such a manner that it exerts the necessary wedge forces even when the wedge element 22 should yield during the operation.

For the purpose of dismounting, the nuts 24 are released. Then the tension bolt 23 is pivoted in the direction of the arrow 28 shown on FIG. 1. This is possible without difficulties, due to the cylindrical shape of the wedge element 22. Thereafter it is lifted in the direction of the arrow 29 and turned about the longitudinal axis of tension bolt 23 by 90°, as indicated in dot and dash lines on FIG. 1. Thereafter the tension bolt with the wedge element can be removed downward through the correspondingly large interspace between the projections 17. In the mounting the process is reversed.

The projection 27 which represents the wedge surface 21 on the front flange 7 of the grate plate support is provided symmetrically in the center between projections 10. Its width is smaller than the space between projections 17 which support wedge surfaces 20, on the grate plate. The flange 7 of the grate plate support is lowered on both sides, beside the projection 27 at a plate recess 30 to a level that is lower than the lowest places of the projection 17 in assembly. Due to these features, the grate plate can be pushed forward in the dismounting process in the direction of the arrow 31, shown on FIG. 2, without being lifted with respect to their position of operation. When the grate plate support 2 is in its rearmost position, as shown on FIG. 2, the grate plate can therefore be pushed forward, without dismounting the grate plate located in front or behind the said grate plate, to such a position 33 shown in dot and dash lines on FIG. 2, that subsequently it can be pivoted into the position 34 indicated there in dot and dash lines, and finally can be removed through the gap between grate plate supports 2 and 1 downward, as indicated there in full lines. The ribs 13 and projections 17 of the grate plate are angularly slanting on their rearside 35 so as to facilitate the transition from position 33 into position 34.

Thus, according to the invention the traction element engages, by means of keying, the grate plate which has a wedge surface on the grate plate extending slantingly to the support surface and in the direction opposite to the stop surface. A wedge surface on the grate plate support together with the wedge surface on the plate encloses a wedge angle, and a wedge element pulled by the traction element into the wedge angle. The wedge element transfers by means of the grate plate wedge surface, forces transversely to the support surface whereby the grate plate is held on the support surface. The wedge element also transfers forces acting in the longitudinal direction of the plate, which latter forces are absorbed by the stop surface. The grate plate is thereby held rigidly with respect to the grate plate support in all directions of stress. The wedge angle (see arrow on FIG. 1) is below 90°, preferably between about 50° and 80° with optimum results at about 65°. At 90° of the wedge angle mounting could not be efficiently accomplished; below 50° the horizontal power component would be insufficient. In this structure the traction element needs only to absorb the forces that hold the wedge element in the intended position. These forces are substantially smaller than the fastening forces required directly between the grate plate and the grate plate support. Since the wedge connection can be arranged so that the traction element points downward, the latter can easily be removed from the thermal stress. The employment of the wedge connections presents the advantage of ease of mounting and dismounting.

The wedge connection is arranged between a front and a rear portion of the support surface, in order to absorb torques of any direction. The arrangement of the stop surface and the wedge surface of the grate plate at the same lower plate projection permits absorption of the wedge forces on the stop surface so that they can be directly transferred without stressing other plate portions. In this arrangement the stop surface is preferably on the side of the projection that faces the rear positioned so that it can transfer the forces directed toward the rear upon the plate. However, the inverse arrangement is also feasible especially in the fixed grate plates which are stressed to a greater extent in the direction of the forward thrust.

The grate plate fastenings are constructed in such a manner that individual grate plates can be dismounted without dismounting adjacent grate plates. For this purpose after the release of the fastening it must be possible to pull them out, in the direction of their forward thrust so as to make it possible subsequently to pivot them downward through the gap between their grate plate support and the plate in front of it.

The wedge connection of the invention is arranged so that the wedge surfaces on the grate plate support and on the grate plate cooperate and therefore in principle face each other, seen in the longitudinal direction of the plate. Thereby the removal of a plate in its longitudinal direction from the position in which it is placed in the assembled device may be rendered more difficult. In order to facilitate nevertheless the longitudinal displacement of the plate according to the invention the grate plate support has in front of each projection which supports a wedge surface, a recess which permits the forward displacement of the grate plate in the direction of the forward thrust. The corresponding wedge surface of the grate plate support is correspondingly arranged in lateral displacement. In order to avoid undesired torques with a moment axis transversely to the plate plane, the mutually displaced wedge surfaces are suitably arranged symmetrically. Especially it is possible to provide the grate plate with two projections, each of which supports a wedge surface. These projections are spaced from each other, this space being at least as large as the width of a projection on the grate plate support, which supports the corresponding wedge surface on the opposite side. It is also within the scope of the invention to provide instead two wedge surfaces on the grate plate support and only one wedge surface on the grate plate. However, the arrangement of two wedge surfaces on the grate plate is preferable because the corresponding two abutment surfaces permit a clear positioning of the grate plate, whereas only one stop surface of the plate, narrow in transversal direction of the plate, still will allow a certain rotation in the horizontal plane.

The wedge element and the wedge surfaces may be of any shape which provides cooperation between them and makes possible the desired wedge effect. For instance, level wedge surfaces and a wedge element that is round in cross section and is likewise wedge-shaped may also be combined with each other. When the wedge element is wedge shaped, the shape of the wedge surfaces is not of importance. The latter may then be shaped, with respect to the wedge element, as cams of any convex shape.

The wedge element can be connected with a tension bolt directly and possibly so as to form one piece therewith. The tension rod is shaped, for instance, as a screw bolt whose nut is supported on a correspondingly shaped support element of the grate plate support. For the absorption of the expanding motions a conventional spring may be interposed between the nut and the support element. To facilitate the assembly, the support element of the grate plate support is shaped in a forklike manner, so that the bolt can be moved out laterally from the support element. The aperture of the fork is directed in the longitudinal direction of the grate plate in order to permit a movement of the bolt from the fork or into it by a simple pivoting about the longitudinal axis of the wedge element which for this purpose is advantageously cylindrical. Especially the forklike support element is arranged on the backside of a front flange element of the grate plate support and in such a way as to open toward the rear.

When the wedge element is connected with the tension rod bolt so as to form a single piece therewith, it is necessary to provide space for the introduction of the tension bolt below the wedge surfaces of the grate plate and the grate support on the open side of the forklike support element of the grate plate support through which the tension bolt with the wedge element can be moved during assembly and disassembly.

What is claimed is:

1. A thrust grate comprising:

a plurality of rows of grate plates;

each preceding row of plates overlapping the next following row of plates;

said rows of grate plates being alternatingly rigidly fixed and reciprocable in longitudinal direction of the grate;

grate plate supports arranged transversely to the longitudinal direction of the plates;

the rigidly fixed grate plates provided with fastening devices on said supports;

each said fastening device having:

support rib and plate surfaces extending essentially parallel to the longitudinal direction of the grates;

a stop surface, extending transversely to the said support surfaces on the grate plate support and on each grate plate;

a traction element holding the grate plate on the grate plate support; and a wedge connection;

said wedge connection being formed by a wedge surface extending slantingly to the support plate surface and the support rib surface and in opposite direction to the said stop flange and plate surface on the grate plate, a wedge surface enclosing therewith a wedge angle on the reciprocable grate plate support and a wedge element pulled by the traction element into the wedge angle;

said traction element engaging by means of said wedge connection the said grate plate.

2. A thrust grate as claimed in claim 1, the said support surface being a front plate and rib support surface portion and a rear plate and rib support surface portion between which the wedge connection is located.

3. A thrust grate as claimed in claim 2, the said stop flange and plate surfaces and the said wedge surface of the reciprocable grate plate being arranged on the same lower plate projection.

4. A thrust grate as claimed in claim 3, the said stop plate surface on the plate projection facing the rear.

5. A thrust grate as claimed in claim 3, the said reciprocable grate plate support having in front of each said plate projection that supports a wedge surface a plate recess which permits the advance of the grate plate in the direction of the forward thrust.

6. A thrust grate as claimed in claim 2, further comprising:

a reciprocable projection on the reciprocable plate support;

the said reciprocable thrust plate being provided with two plate projection spaced from each other, each said plate projection supporting a wedge surface, the space between them being at least as large as the width of said reciprocable projection provided on the reciprocable grate plate support, supporting the corresponding opposite wedge surface.

7. A thrust grate as claimed in claim 1, said wedge element being connected with a tension belt which is supported by a supporting element of the fixed grate plate support which opens in a forklike manner in the longitudinal direction of the grate plate.

8. A thrust grate as claimed in claim 7, further comprising:

a frontal flange element of the grate plate support, the forklike support element being arranged on the rear side of said frontal flange element to open toward the rear.

9. A thrust grate as claimed in claim 7, further comprising:

a space below the wedge surfaces of the reciprocable grate plate and the reciprocable grate support, on the open side of the forklike support element of the grate plate support sufficient for the introduction of the tension bolt.

10. A thrust grate as claimed in claim 1, further comprising:

a space above the wedge surfaces of the reciprocable grate plate and the reciprocable grate support sufficient for the turning of the said wedge element.

11. A thrust grate as claimed in claim 1, further comprising:

an inter space between the reciprocable grate support and the fixed plate which is the next in the rear;

said grate plate being provided, on its back side with a slope to facilitate the removal of the plate from the said interspace.

12. A thrust grate as claimed in claim 1, said reciprocable grate plate support having a front and a rear flange element which in the transversal section extend essentially in vertical direction and bridges which connect this flange.

13. A thrust grate as claimed in claim 2, said support plate surfaces on the side of the reciprocable grate plate support being provided on the top sides of the flange elements.

* * * * *